US012698127B2

(12) United States Patent
Lavender et al.

(10) Patent No.: US 12,698,127 B2
(45) Date of Patent: Aug. 4, 2026

(54) MID-AIR RELEASE MODULE ASSEMBLY

(71) Applicant: Capewell Aerial Systems LLC, South Windsor, CT (US)

(72) Inventors: Mark H. Lavender, South Windsor, CT (US); Adam J. Fitzgerald, South Windsor, CT (US); John Derewianka, South Windsor, CT (US); Peter Carlisi, South Windsor, CT (US)

(73) Assignee: Capewell Aerial Systems LLC, South Windsor, CT (US)

( * ) Notice: Subject to any disclaimer, the term of this patent is extended or adjusted under 35 U.S.C. 154(b) by 413 days.

(21) Appl. No.: 18/393,115

(22) Filed: Dec. 21, 2023

(65) Prior Publication Data

US 2025/0206500 A1 Jun. 26, 2025

(51) Int. Cl.
*B65D 19/44* (2006.01)

(52) U.S. Cl.
CPC .... *B65D 19/44* (2013.01); *B65D 2519/00805* (2013.01)

(58) Field of Classification Search
CPC ..... B65D 19/44; B65D 2519/00805; B60P 3/079; B64D 1/02; B64D 1/08; B64D 1/12
USPC ..... 410/100, 7, 4, 23, 46, 77, 79; 244/137.1, 244/63; 248/499
See application file for complete search history.

(56) References Cited

U.S. PATENT DOCUMENTS 8,414,235 B2 * 4/2013 Parkinson ..... B60P 3/073 410/97
2022/0324368 A1 * 10/2022 Parkinson ..... B60P 3/079

OTHER PUBLICATIONS

PCT International Search Report and Written Opinion for International Application No. PCT/US2023/085525 filed Dec. 21, 2023; Date of Mailing: Jul. 3, 2024; 10 pgs.

* cited by examiner

*Primary Examiner* — Amy R Weisberg
*Assistant Examiner* — Daniel R Digiovannantonio
(74) *Attorney, Agent, or Firm* — Alix, Yale & Ristas, LLP

(57) ABSTRACT

A mid-air release module uses one or more bias members to move a ram connected to one or more cables to release at least one releasable coupling connecting cargo to an air cargo platform. The ram is held in a cocked position by a release lever held in a first position by a trigger until the occurrence of a triggering event. When released, the release lever moves to a second position, allowing the ram to move and exert a simultaneous pulling force on the cables to open releasable couplings connecting the cargo to the platform at the same time. A release module using force generated by bias members such as springs does not need a power source and will function reliably in adverse conditions.

15 Claims, 10 Drawing Sheets

MID-AIR RELEASE MODULE ASSEMBLY

BACKGROUND

The disclosure relates generally to aerial delivery systems. More specifically, this disclosure relates to mechanisms used to release elements of a system securing cargo to a platform.

For aerial delivery systems to which the disclosure relates, cargo is secured to a platform which is loaded into the aircraft. The platform is extracted from the aircraft by an extraction parachute. Suspension parachutes are subsequently opened to complete the aerial delivery. The cargo is secured to the platform by various techniques which may, for example, include flexible straps secured around the cargo and placed in tension. For aerial delivery which involves land delivery, upon landing of the cargo, the straps are released to obtain access or usage of the cargo. For aerial delivery of vehicles, typically, multiple pairs of straps are employed. The straps are latched about the axles or other connection points at the underside of the vehicle and placed in tension. Upon landing of the platform, typically, each of the latch assemblies is released so that the cargo vehicle may be unloaded from the platform. U.S. Pat. No. 8,414,235 describes a Single Point Release System which allows a series of latches to be simultaneously released from a single control lever. This simplifies and reduces the time required to release cargo from a platform. The manually actuated control lever disclosed in U.S. Pat. No. 8,414,235 is suitable for various applications, however in other applications it is desired to have the capability for dropping payloads autonomously, or remotely operated.

U.S. Patent Application Publication No. 2022/0324368 discloses an automatic single point release system including latches released by a control cable and a control box connected to the cables. The control box is configured to automatically and concurrently release the latches in response to a predetermined condition or event. The control box includes a source of power such as a battery used to drive a linear actuator that is connected to the cables and when retracted by the control box, puts all the cables under tension at the same time, releasing the latches. The control box has electronic circuitry that receives signals from sensors such as a pressure altimeter or accelerometer to determine when the control box retracts the actuator to release the payload. A timer may also be used to provide a signal to the control box to release the payload. The sensors or timer may be part of the control box or connected to the control box. The control box has some complexity that can be undesirable in situations without access to replacement parts or supplies such as batteries. Electronic circuits may be susceptible to magnetic pulses or other environmental conditions in military training or battle scenarios, and disaster recovery situations can limit access to repair parts and supplies. Electronic circuits may produce electromagnetic fields that can interfere with sensitive systems present in aircraft and radio communications equipment.

There is a need for an improved release mechanism for air cargo payloads that is simple, durable, and reliable in the harshest operating environments.

There is a need for an improved release mechanism for air cargo payloads that can be triggered by a variety of initiating devices to release cargo from airdrop platforms in mid-air or upon landing.

There is a need for an improved release mechanism that will generate no electromagnetic interference.

SUMMARY OF THE INVENTION

A release module assembly for a mid-air cargo release system is disclosed. An embodiment of the release module assembly includes a frame having a first end, a second end and first and second sides extending between the first and second ends. A bar extends between the first and second sides and is mounted in a fixed position spaced apart from the first and second ends of the frame. The bar defines a plurality of openings extending in a longitudinal direction. A ram extends between the first and second sides and is movable in a longitudinal direction between a retracted first position and an extended second position relative to the bar. At least one spring or bias member is compressed between the bar and the ram to bias the ram toward the second position.

A plurality of rods extend in a longitudinal direction through the plurality of openings in the bar. A first end of each of the plurality of rods is connected to the ram for movement with the ram between the first and second positions, and a second end of each rod extends from the bar in a longitudinal direction toward the first end of the frame.

A lock beam is moveable between a cocked position holding the ram in the first position and a released position allowing the ram to move to the second position. A release lever is moveable between a first position holding the lock beam in the cocked position and a second position allowing the lock beam to move to the released position. Movement of the release lever from the first position to the second position allows the lock beam to move to the released position, and the at least one spring or bias member extends to move the ram to the second position. The ram pulls the connected rods away from the first end of the frame, which movement is used as an actuating force when connected to mechanical cables extending between the release module assembly and releasable couplings securing cargo to a cargo platform.

In some embodiments the release lever includes a roller that contacts the lock beam when the lock beam is in the cocked position. In some embodiments the lock beam extends from a pivot end pivotably mounted relative to the frame and a tip engaged by the latch, the lock beam pivoting about the pivot end to move from the cocked position to the released position. In some embodiments the ram includes a projection extending toward the second end of the frame, the projection contacting the lock beam between the lock beam pivot end and the tip of the lock beam. In some embodiments, the lock beam tip moves toward the second end of the frame when the lock beam moves from the cocked position to the second position.

In some embodiments, the bar defines a guide opening at a midpoint of the bar, a guide rod extends from the ram through the guide opening to guide movement of the ram as it moves between the retracted first position and the extended second position. In some embodiments, the frame includes a center wall extending from the first side of the frame toward the second side of the frame. The lock beam may include front and rear arms on opposite sides of the center wall, the front and rear arms pivotably mounted at a lock beam pivot end adjacent the first side of the frame. The lock beam may have a tip opposite the lock beam pivot end, and the tip may be arranged between the front and rear arms and aligned with the center wall.

In embodiments of a release module assembly including the center wall extending from the first side of the frame toward the second side of the frame, the ram may include projections extending toward the frame second end on opposite sides of the center wall, the projections contacting the lock beam on opposite sides of the center wall between a pivot end of the lock beam and a tip of the lock beam where the lock beam engages the release lever.

Disclosed embodiments of a release module assembly may be used in an air cargo system incorporating a plurality of cable assemblies secured at the first end of the frame. Each of the cable assemblies includes a sheath fixed to the first end of the frame and a cable extending within and moveable relative to the sheath. Each of the cables is connected to the second end of each of the plurality of rods so movement of the plurality of rods away from the first end of the frame exerts a pulling force on the plurality of cables at the same time.

In some embodiments of a release module assembly, the release lever is pivotably mounted at the frame second end and extends to a free end. A safety pin holds the release lever in the first position by contacting the release lever between the frame second end and the free end of the release lever. The release lever is biased toward the second position where the lock bar is released so that removal of the safety pin and release of the release lever allows the release lever to move to the second position. A trigger mechanism can be coupled to the release lever to hold the release lever in the first position until the occurrence of a triggering event and upon occurrence of the triggering event, allows the release lever to move to the second position. The trigger mechanism may be a timer, a pressure altimeter, or a sensor.

The release module assembly may be incorporated into a single point release system including a platform, a plurality of latches connecting at least one strap to the platform, each latch including a releasable latch arm, a rocker arm, and a control cable. The control cable is connected to control the position of the rocker arm and each latch is releasable from a payload on the platform in response to a position of the rocker arm. The control cable of each latch is connected to one of the plurality of rods and movement of the release lever to the second position in response to a predetermined condition simultaneously releases each of the plurality of latches.

DETAILED DESCRIPTION

Figure 12:
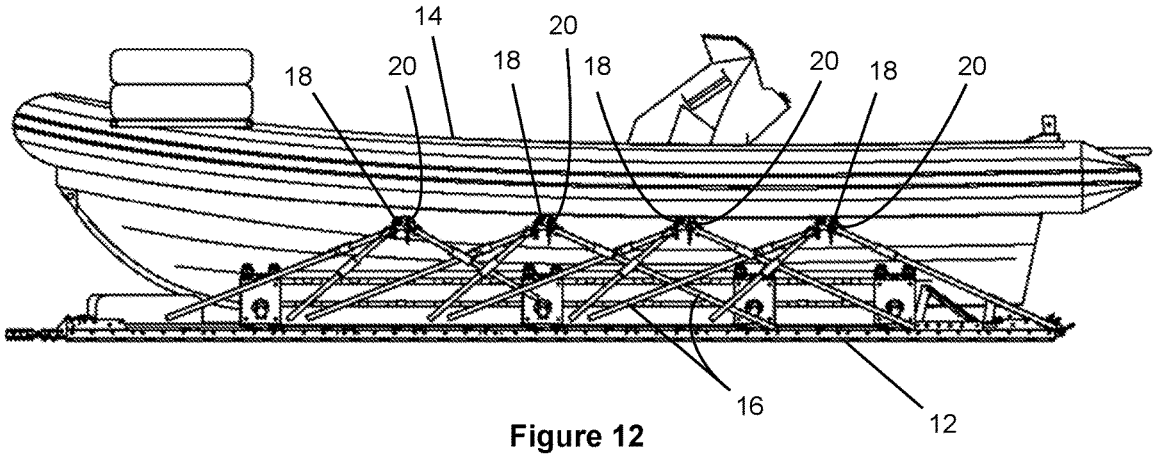
FIG. 12 illustrates a representative air cargo assembly incorporating a single point release system compatible with a release module assembly according to aspects of the disclosure.
Figure 13:
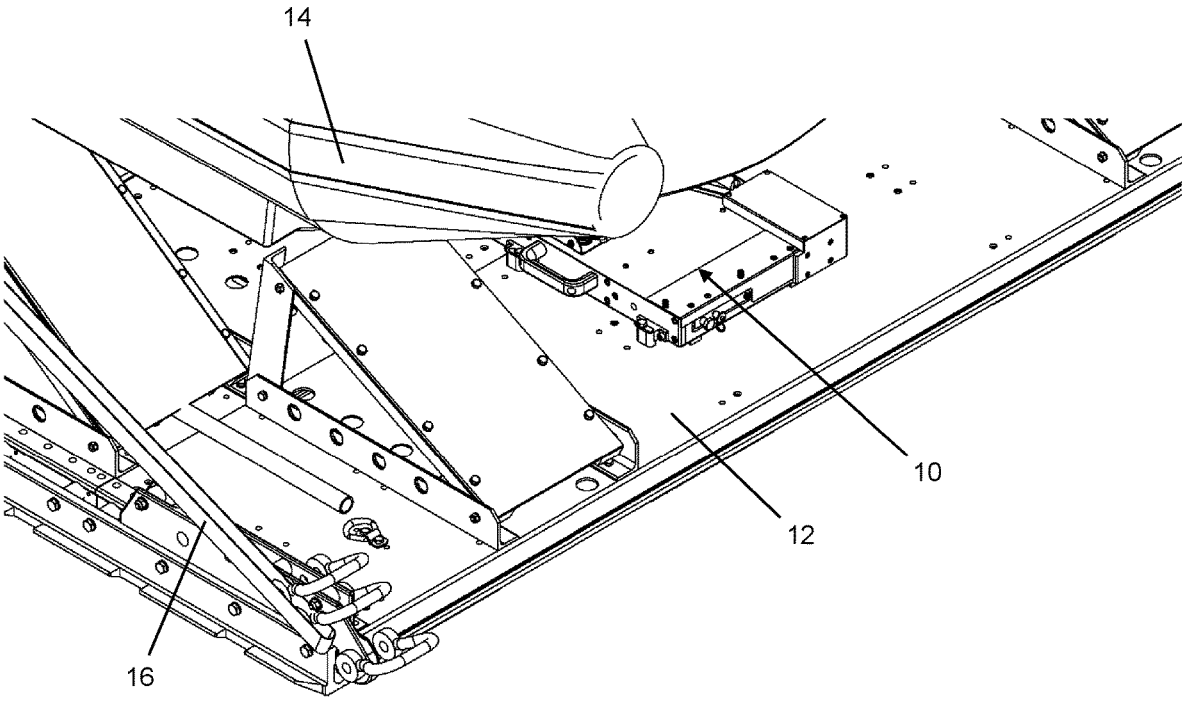
FIG. 13 is an enlarged rear perspective view of the air cargo assembly of FIG. 12, showing a release module assembly mounted to an air cargo platform according to aspects of the disclosure.

FIGS. 1-7 disclose a representative embodiment of a release module assembly 10 for use as a cargo release mechanism in an aerial cargo delivery system. The disclosed release module assembly 10 is configured to be compatible with cargo handling systems in aircraft configured for aerial delivery of cargo. Aerial delivery aircraft are equipped with rows of rollers in the floor that support platforms loaded with cargo, where the rollers allow the loaded platforms to be extracted from a rear (aft) door of the aircraft. Aerial delivery aircraft are fitted with two rails that support and guide platforms loaded with cargo during loading and delivery/extraction. Further, these rails include latches which can lock the platform in the aircraft. The cargo is connected to the platform and the platforms are connected to the aircraft to ensure stability of the cargo during takeoff and maneuvering of the aircraft. FIG. 12 illustrates a representative cargo platform 12 loaded with a marine craft 14. The marine craft is secured to the platform by hold down straps 16 extending between attachment points 18 on the hull of the marine craft 14 and the platform 12 to secure the marine craft 14 to the platform 12 for loading and transport. Each of the attachment points 18 includes a releasable coupling 20 through which the hold down straps 16 extend. Flexible cable assemblies 22 connect the releasable couplings 20 to a release mechanism such as the release module assembly 10 illustrated in FIGS. 1-11. The hold down straps 16 extend through or connect to attachment points on the platform 12. The number of hull attachment points 18 and straps 16 can be selected as needed to secure different cargo to a platform 12. The system of releasable couplings 20 and release module assembly 10 allows the cargo to remain securely attached to the platform 12 during loading and transport and be reliably released from the platform 12 once clear of the delivery aircraft. The release module assembly 10 may be secured to the platform 12 in any convenient location as shown in FIG. 13 using mounting brackets 13. The flexible cable assemblies 22 are routed from the release module assembly 10 to the releasable couplings 20 along paths that do not interfere with release of the cargo or function of the cable assemblies 22.

Figure 1:
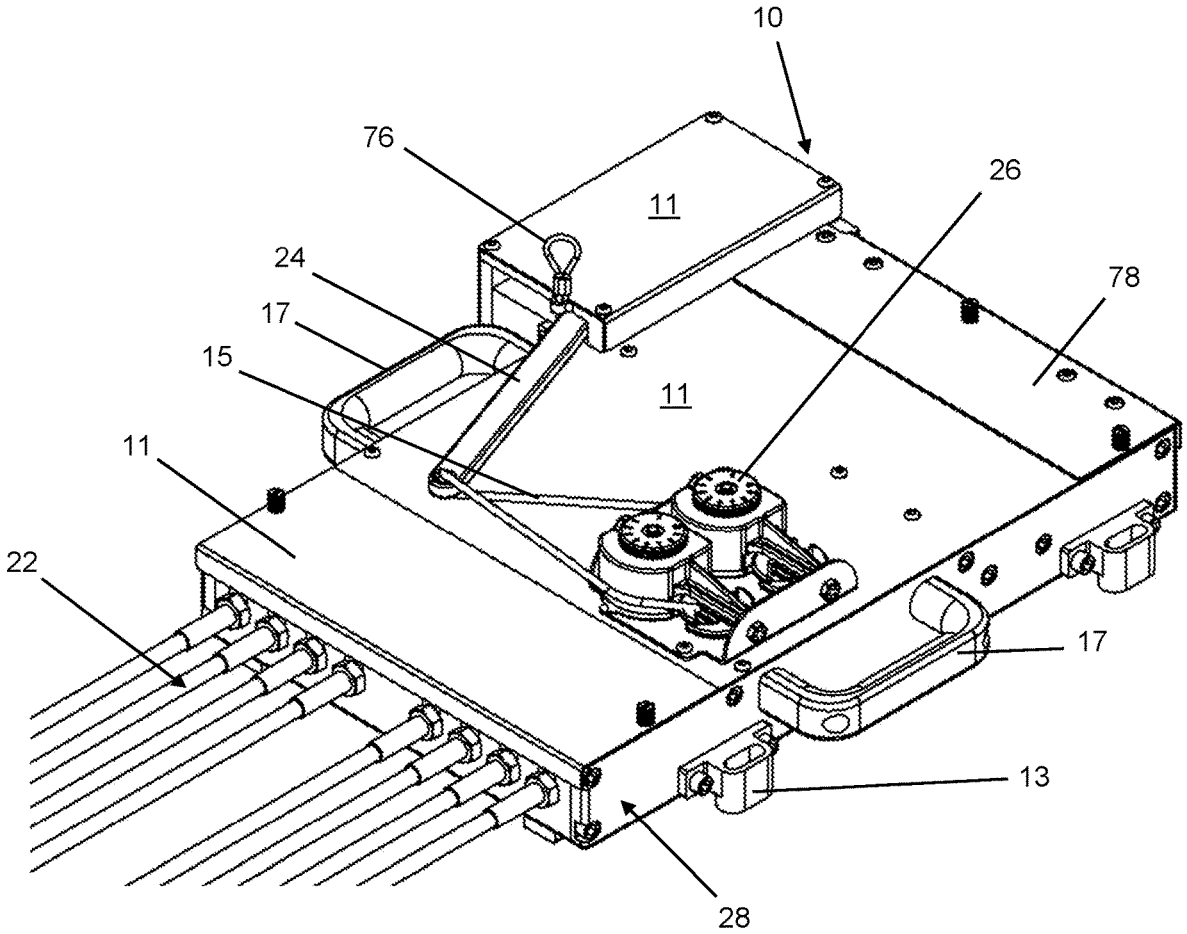
FIG. 1 is an exterior perspective view of an embodiment of a mid-air release system release module assembly in a locked configuration according to aspects of the disclosure.

With reference to FIGS. 1-7, the disclosed embodiment of a release module assembly 10 is configured to apply an actuation force to up to eight cable assemblies 22 simultaneously. FIG. 1 illustrates the release module assembly 10 as it would be used in an air cargo delivery system, e.g., with the cable assemblies 22 connected and the release lever 24 secured in a latched position by a trigger device 26. In FIG. 1, the trigger device 26 is a dereefer which includes a mechanical timer that releases a latch after a selectable time. The dereefer (or other trigger device 26) is connected to a free end of the release lever 24 by a cord 15. In FIG. 1, release of the dereefer latch releases the cord 15 allowing the release module assembly release lever 24 to move from the latched position as shown in FIGS. 1-4 to a released position shown in FIGS. 5-7. The release lever 24 extends outside the release module assembly 10 and can be connected to any known timing or release device such as a pyrotechnic line cutter, an electromechanical pin puller, or a pressure altimeter in addition to the dereefer shown in FIG. 1.

Figure 2:
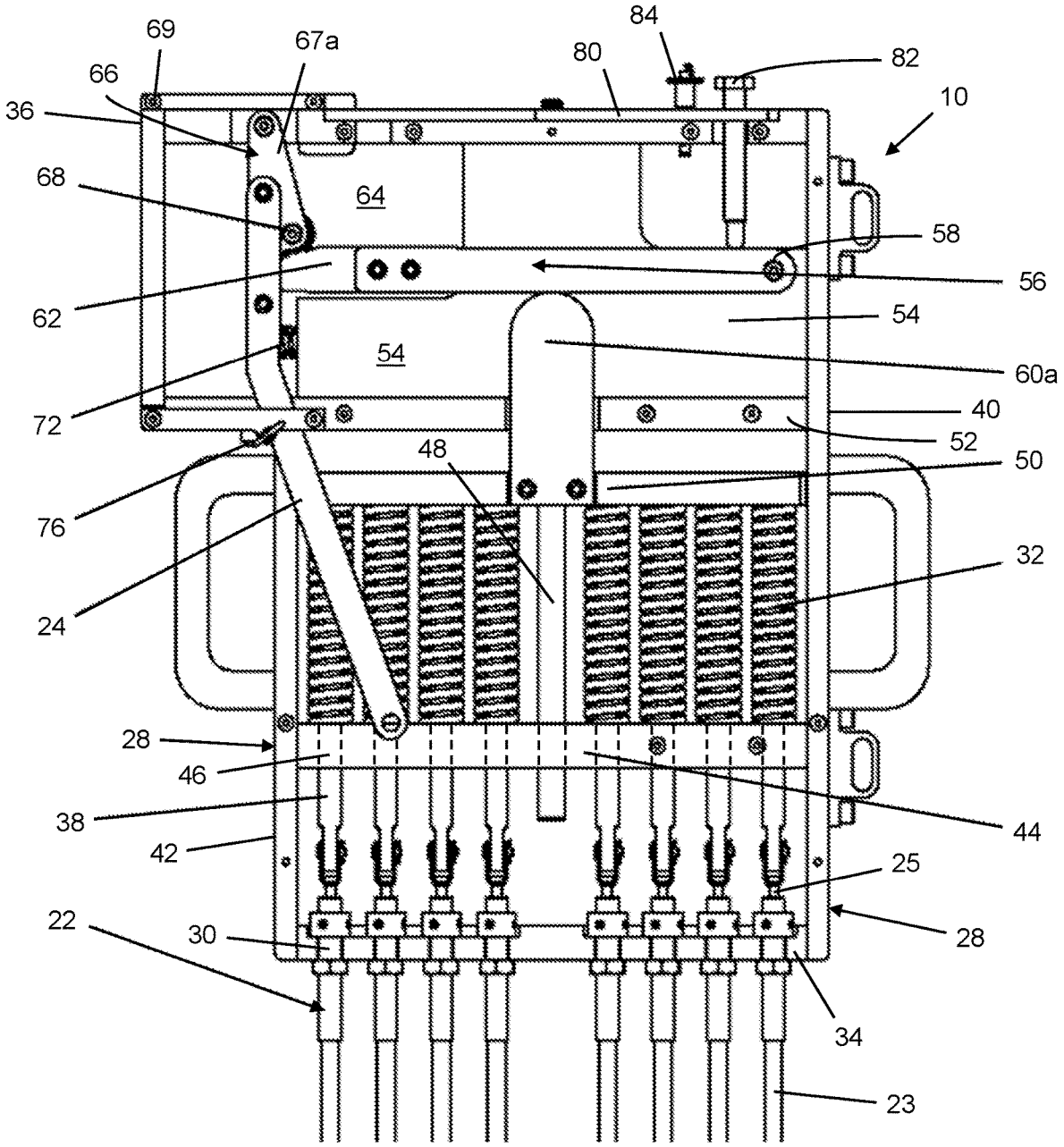
FIG. 2 is a front plan view of the release module assembly of FIG. 1, with exterior panels removed to show internal components in a locked configuration.
Figure 3:
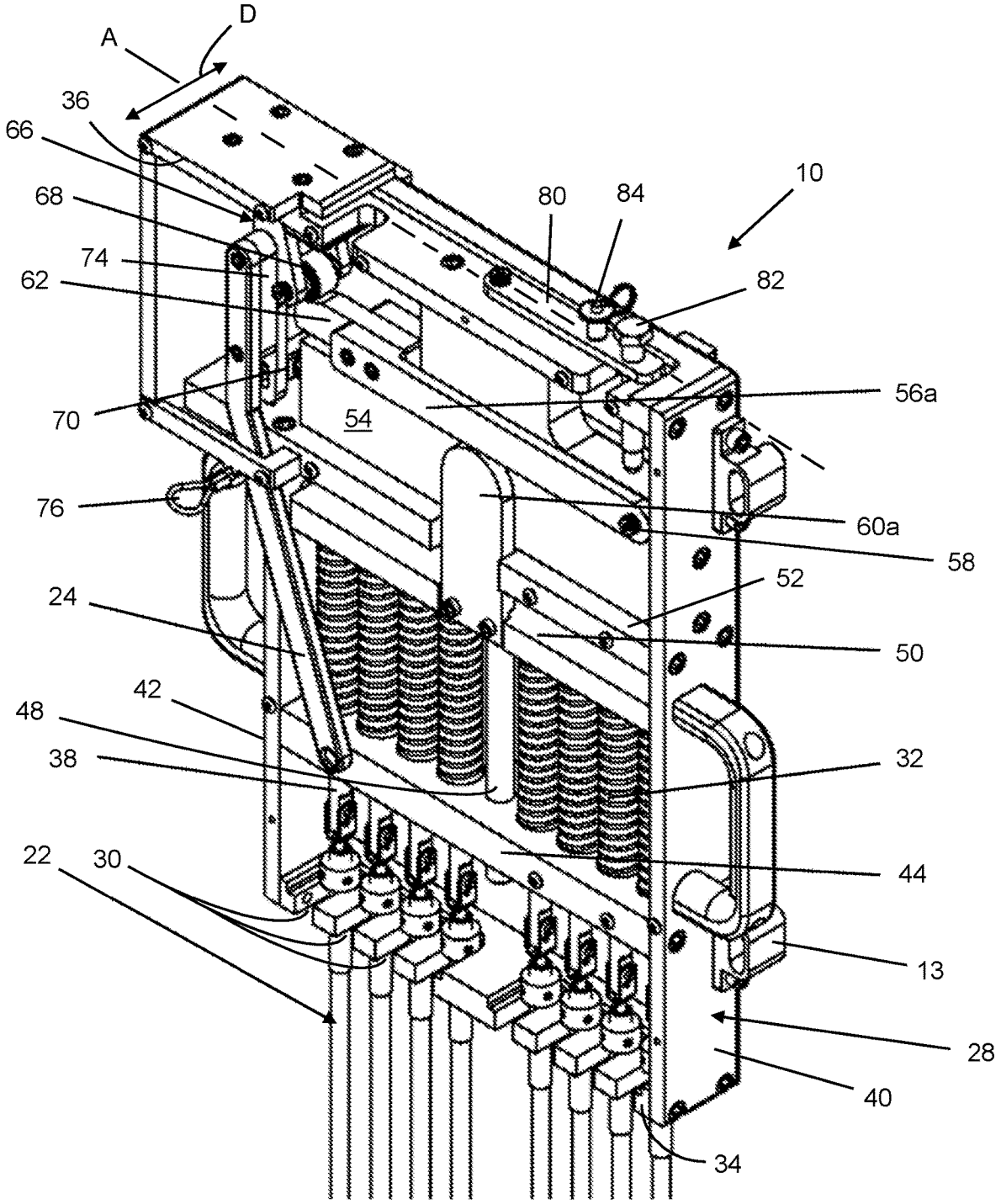
FIG. 3 is a front perspective view of the release module assembly of FIG. 1 from above, with exterior panels removed to show internal components in a locked configuration.
Figure 4:
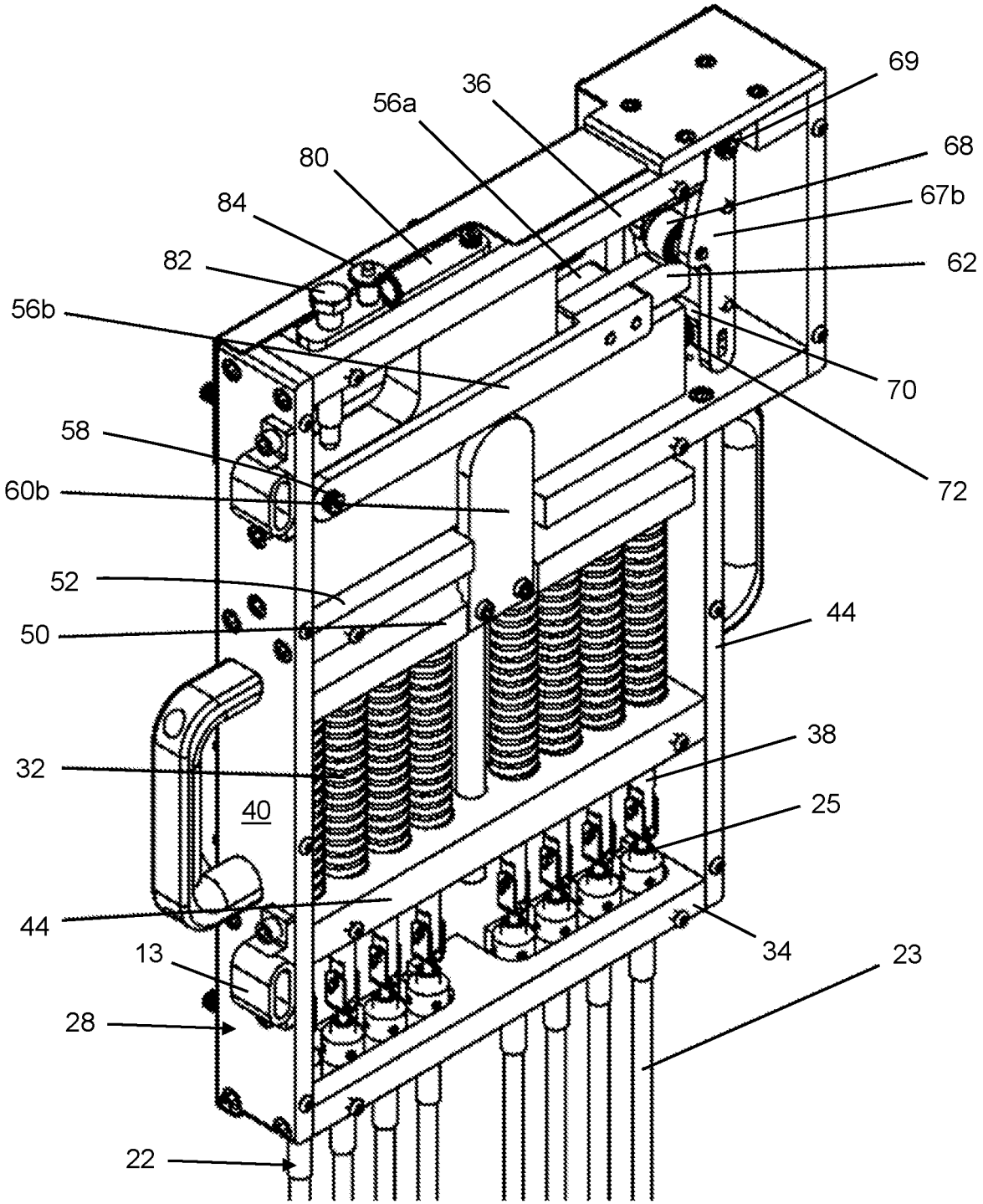
FIG. 4 is a rear perspective view of the release module assembly of FIG. 1 from above, with exterior panels removed to show internal components in a locked configuration.

The release module assembly 10 includes a rigid frame 28 for support of internal components and to which covers 11 are mounted to enclose the internal components during use. Carry handles 17 are arranged on either side of the frame 28 to facilitate handling of the release module assembly 10. One end 34 of the frame 28 includes openings 30 to receive one or more cable assemblies 22, and in the disclosed embodiment includes openings 30 for up to eight cable assemblies 22. The disclosed release module assembly 10 relies on compressed springs 32 contained within the frame 28 to generate the actuation force applied to the cable assemblies 22 and so does not include or require any battery or other power source. In addition, the release module assembly 10 does not include any electronic controls or components and therefore does not generate any electromagnetic interference (EMI). The disclosed release module assembly 10 has two states, a cocked state in which the internal springs 32 are held in a compressed position and the release lever 24 is in the latched position as shown in FIGS. 1-4, and a released state in which the release lever 24 is allowed to move from the latched position, releasing the springs 32 to extend within the frame 28 and apply an actuation force to the cable assemblies 22. FIGS. 2-4 illustrate the release module assembly 10 with external covers removed to show the internal components in a cocked state. In this disclosure, the direction of the actuation force generated by the release module assembly 10 is a longitudinal direction, while the direction perpendicular to the actuation force is the lateral direction.

Figure 14:
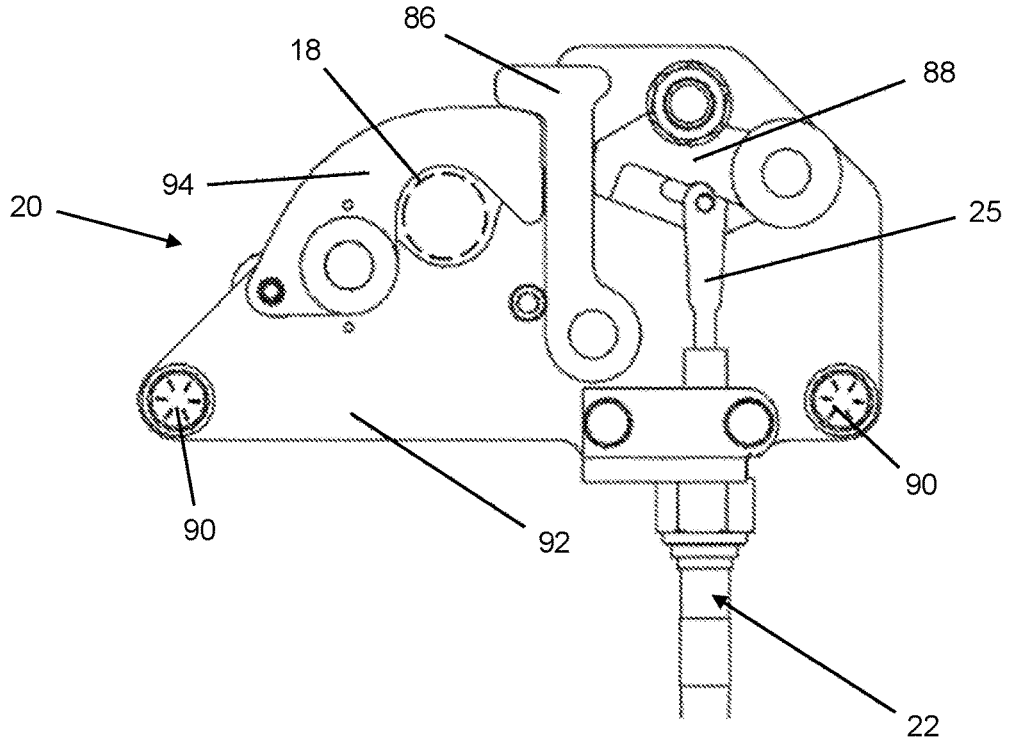
FIG. 14 illustrates one example of a releasable coupling actuatable by the disclosed release module assembly, with the releasable coupling in a latched state.
Figure 15:
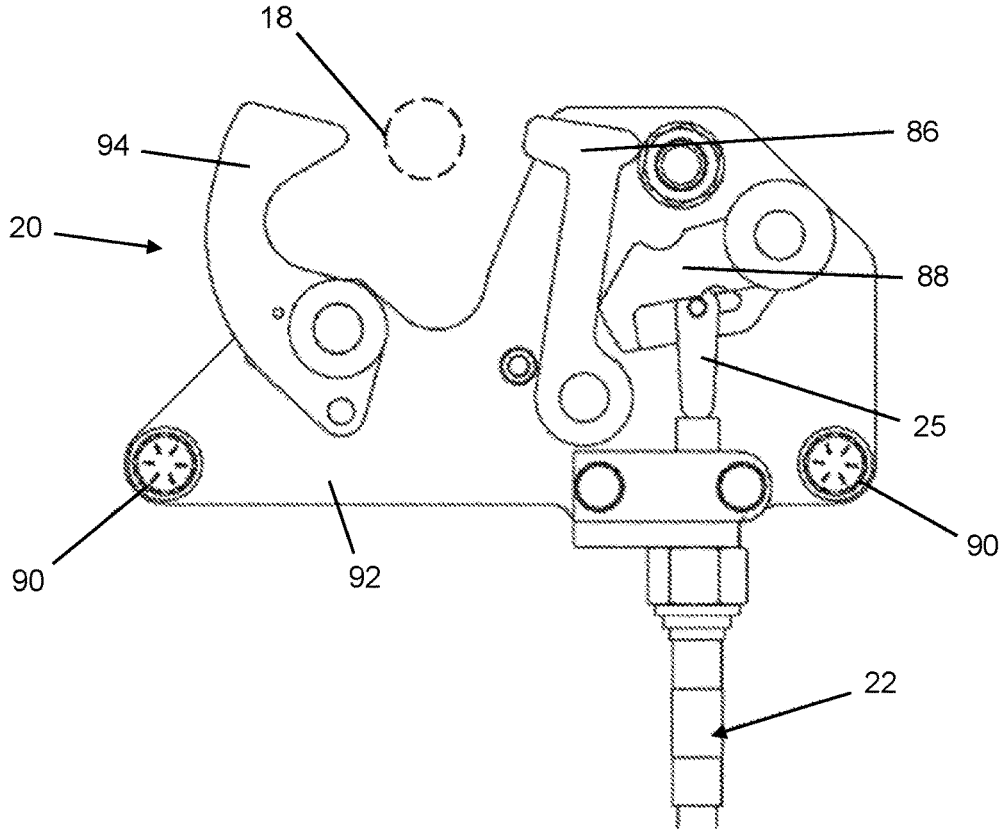
FIG. 15 illustrates the releasable coupling of FIG. 14 in a released state.

The frame 28 of the release module assembly 10 extends longitudinally from a first end 34 that defines openings 30 for up to eight cable assemblies 22 to an opposite second end 36. Each cable assembly 22 has a sheath 23 surrounding a cable 25 that is movable within the sheath 23. Each end of a cable assembly 22 includes couplings or fittings that allow the cable assembly 22 to be secured at one end to the release module assembly 10 and at the opposite end to a releasable coupling 20 as shown in FIGS. 14 and 15. In the disclosed cable assemblies 22, each end of the cable 25 includes a head received in a yoke or a similar means of attaching the cable 25 to another component. The cable 25 is secured to a moveable component of releasable coupling 20 at one end and to actuation rods 38 in the release module assembly 10 at the opposite end. The cable 25 and sheath 23 are flexible and can be routed from the release module assembly 10 to the releasable coupling 20 along a path that will not interfere with the cargo or the straps 16 securing the cargo to the platform 12, while the cable 25 remains free to move within the sheath 23.

Longitudinally extending first and second sides 40, 42 of the frame 28 extend between the first and second ends 34, 36 of the frame to provide a rigid structure to the release module assembly 10. A bar 44 extends laterally between the sides 40, 42 of the frame 28 at a fixed position and defines holes 46 extending in a longitudinal direction for actuation rods 38 and a central guidepost 48. The actuation rods 38 and guidepost 48 are secured at one end to a ram 50 extending laterally between the sides 40, 42 of the frame 28. The ram 50 is movable in a longitudinal direction between a retracted first position (shown in FIGS. 2-4) and an extended second position (shown in FIGS. 5-7) relative to the bar 44 and first end 36 of the frame 28. Each actuation rod 38 extends through the bar 44 and is coupled to a cable 25. In the disclosed embodiment, coil springs 32 surround each actuation rod 38 and are arranged between the fixed bar 44 and the movable ram 50. When the ram 50 is in the retracted position, the springs 32 are compressed and when the ram 50 is allowed to move to the extended position, the springs 32 extend, moving the actuation rods 38 longitudinally away from the first end 34 of the frame 28, thereby applying a simultaneous actuation force to the cables 25. Movement of the ram 50 is partially guided by the guidepost 48. Equal numbers of actuation rods 38 and springs 32 on either side of the guidepost 48 ensure symmetrical force is applied to the ram 50 during movement from the retracted position to the extended position. Guided movement and symmetrical spring force prevent binding of the ram 50 and ensure that the same force is simultaneously applied to each actuation rod 38.

A stop 52 extends between the sides 40, 42 of the frame 28 to limit movement of the ram 50 away from the first end 34 of the frame 28. In the disclosed release module assembly 10, a center wall 54 extends from the stop 52 to the second end 36 of the frame 28. The center wall 54 enhances the structural rigidity of an upper end 36 of the frame 28 and divides the depth of the interior space of the upper end 36 of the frame 28 into front and rear spaces. In the disclosed release module assembly 10, a lock beam 56 includes front and rear arms **56*a*, 56*b* pivotably secured at a lock beam pivot end 58 adjacent to first side 40 of the frame 28. Front and rear projections 60*a*, 60*b* from the ram 50 extend longitudinally toward the lock beam 56 and contact the front and rear arms 56*a*, 56*b* of the lock beam 56 between the pivot end 58 and a tip 62 of the lock beam 56. In the disclosed release module assembly 10 a longitudinal end of the projections 60*a*, 60*b* are semicircular and contact the arms 56*a*, 56*b* of the lock beam 56 approximately midway between the pivot end 58 and the tip 62. The tip 62 of the lock beam 56 is connected between the front and rear arms 56*a*, 56*b* of the lock beam 56, positioning the tip 62 along a center line A of the depth D of the upper portion of the frame 28. The center wall 54 defines a space 64 for movement of the tip of the lock beam between a cocked position shown in FIGS. 2-4 and a released position shown in FIGS. 5-7. In the cocked position, the lock beam 56 holds the ram 50 in the retracted position with the springs 32 compressed between the ram 50 and the bar 44. In the released position, the lock beam 56 allows the ram 50 to move to the extended position, pulling the actuation rods 38 away from the first end 34 of the frame 28. The disclosed configuration of the center wall 54, ram extensions 60*a*, 60*b* and front and rear arms 56*a*, 56*b* of the lock beam 56 balance the forces applied to the ram 50 to ensure smooth and reliable movement of the ram 50** from the retracted to the extended position.

As best seen in FIGS. 3, 4, 6 and 7, the release lever 24 connects to a roller assembly 66 that positions the roller 68 in alignment with the tip 62 of the lock beam 56. The roller assembly 66 includes front and rear brackets 67*a*, 67*b* that define the pivotable connection 69 between the release lever 24 and the frame 28. The front and rear brackets 67*a*, 67*b* extend away from the pivotable connection 69 and include a cross piece 70 against which the release lever spring 72 is seated. The roller 68 is supported between the front and rear brackets 67*a*, 67*b* to rotate about an axle or fastener. A release lever spacer 74 positions the release lever 24 away from the center line A of the depth D of the frame 28 so that the free end of the release lever 24 is accessible from outside the release module assembly 10 as shown in FIG. 1.

As shown in FIGS. 2-4, the lock beam 56 is held in the cocked position by a release lever 24 pivotably connected to the second end 36 of the frame 28. The release lever 24 extends from the pivot 69 to a free end outside the space enclosed within the release module assembly 10, as best seen in FIG. 1. The frame 28 and covers of the release module assembly 10 are configured to allow the release lever 24 to pivot between a first position holding the lock beam 56 in the cocked position as shown in FIGS. 2-4 and a second position allowing the lock beam 56 to move to the released position shown in FIGS. 5-7. The tip 62 of the lock beam 56 has an arcuate profile where it contacts the roller 68 supported by the release lever 24. The arcuate profile of the tip 62 translates bias applied to the lock beam 56 by the ram 50 (via extensions 60*a*, 60*b*) into force on the release lever 24 moving the release lever 24 away from the lock beam 56. In the disclosed release module assembly 10, the release lever 24 includes a roller 68 where the release lever 24 contacts the tip 62 of the lock beam 56. The roller 68 and profile of the tip 62 of the lock beam 56 ensure reliable and low friction movement of the release lever 24 away from the lock beam 56 when the release lever is free to pivot. Further, the release lever 24 is biased away from the lock beam by a release lever spring 72 compressed between the release lever 24 and the center wall 54. The disclosed release module assembly 10 includes a safety pin 76 receivable in an opening or socket defined by the frame 28 and/or covers of the release module assembly 10 to hold the release lever 24 in a first position holding the lock beam 56 in the cocked position. The safety pin 76 ensures the release module assembly 10 remains in its cocked state during set up of the air cargo system. The safety pin 76 can be removed during a final check of the air cargo system or immediately prior to deployment of the air cargo from the aircraft.

Figure 5:
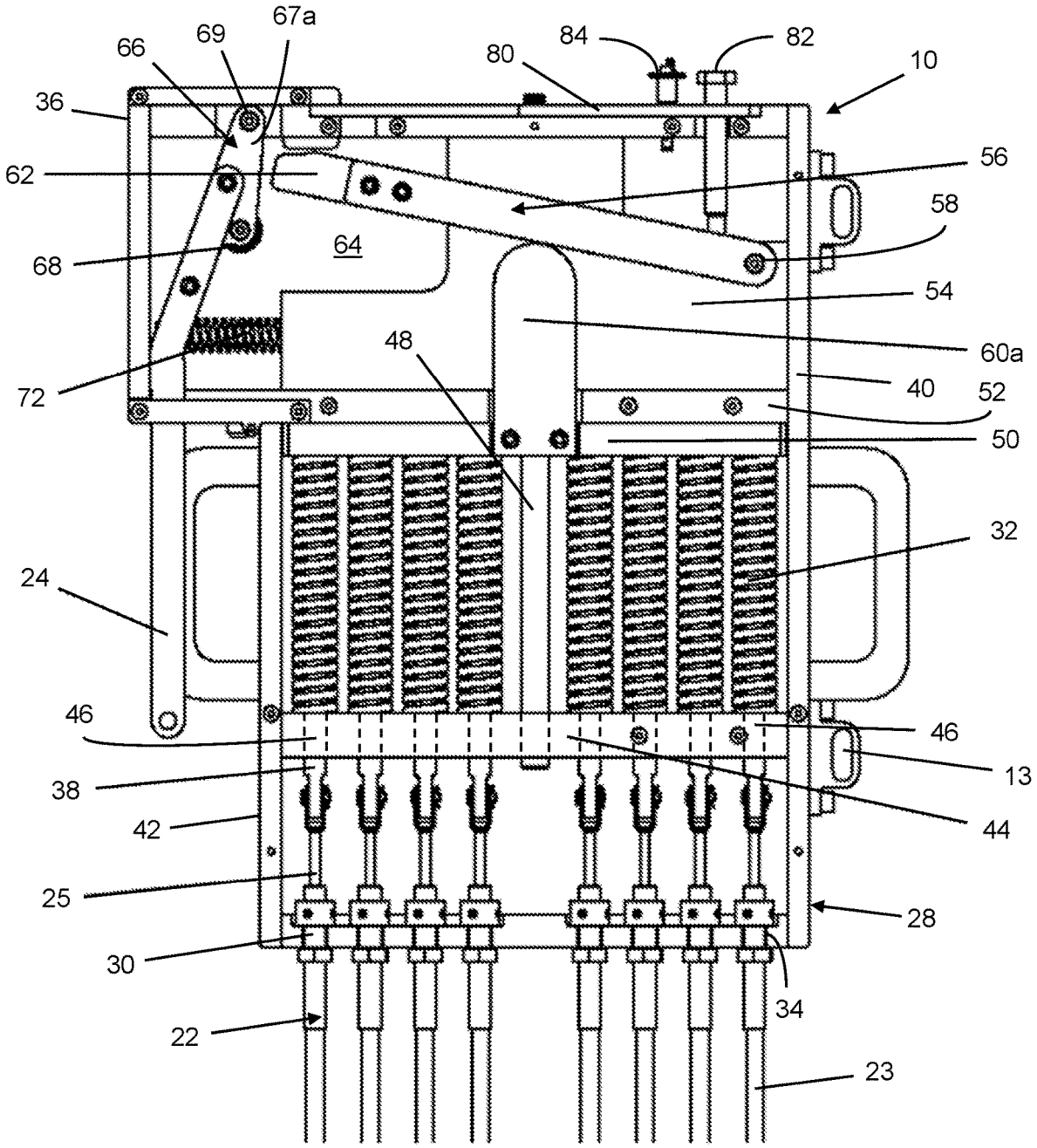
FIG. 5 is a front plan view of the mid-air release system release module assembly of FIG. 1, with exterior panels removed to show internal components in a released configuration.
Figure 6:
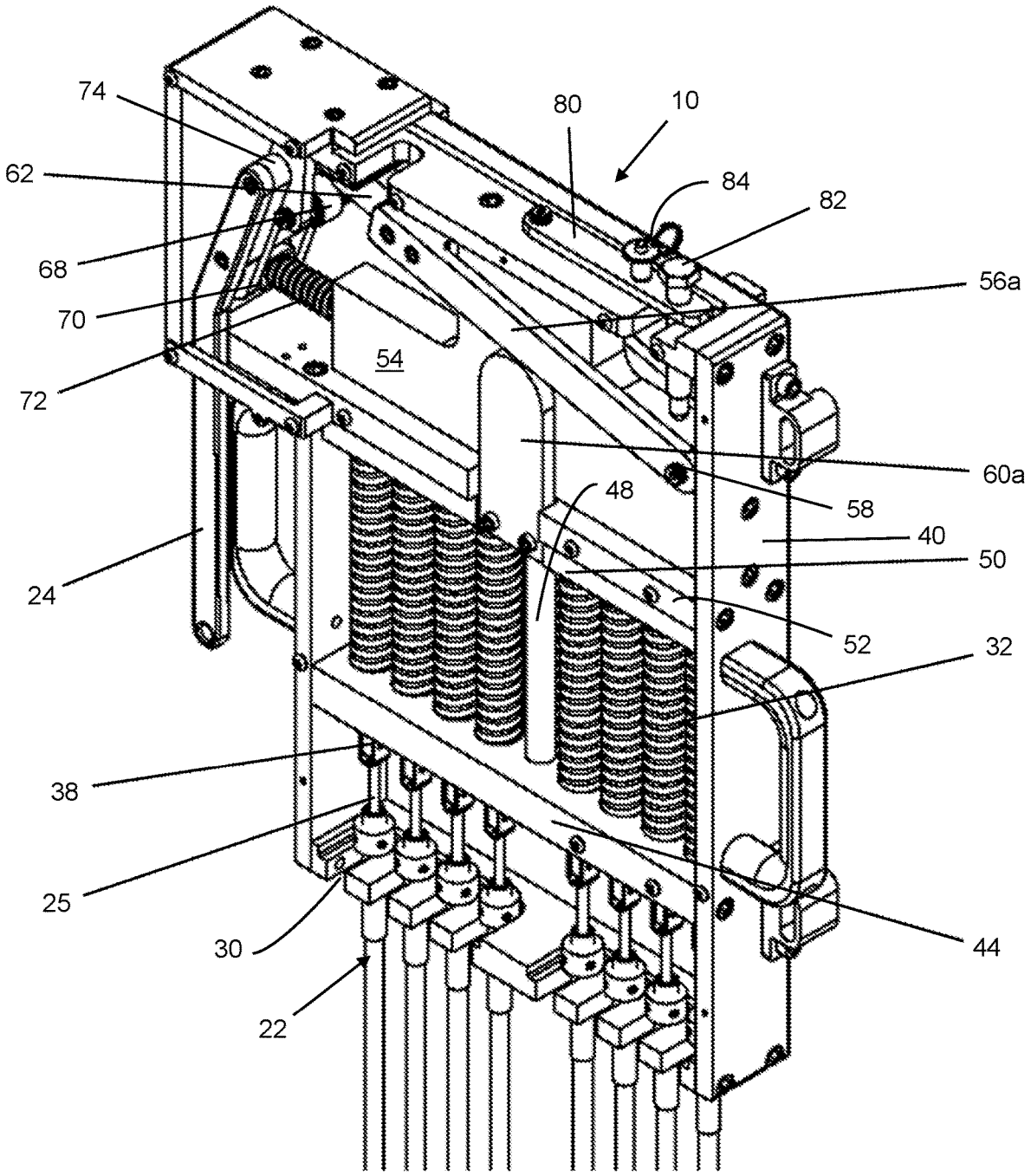
FIG. 6 is a front perspective view of the release module assembly of FIG. 1 from above, with exterior panels removed to show internal components in a released configuration.
Figure 7:
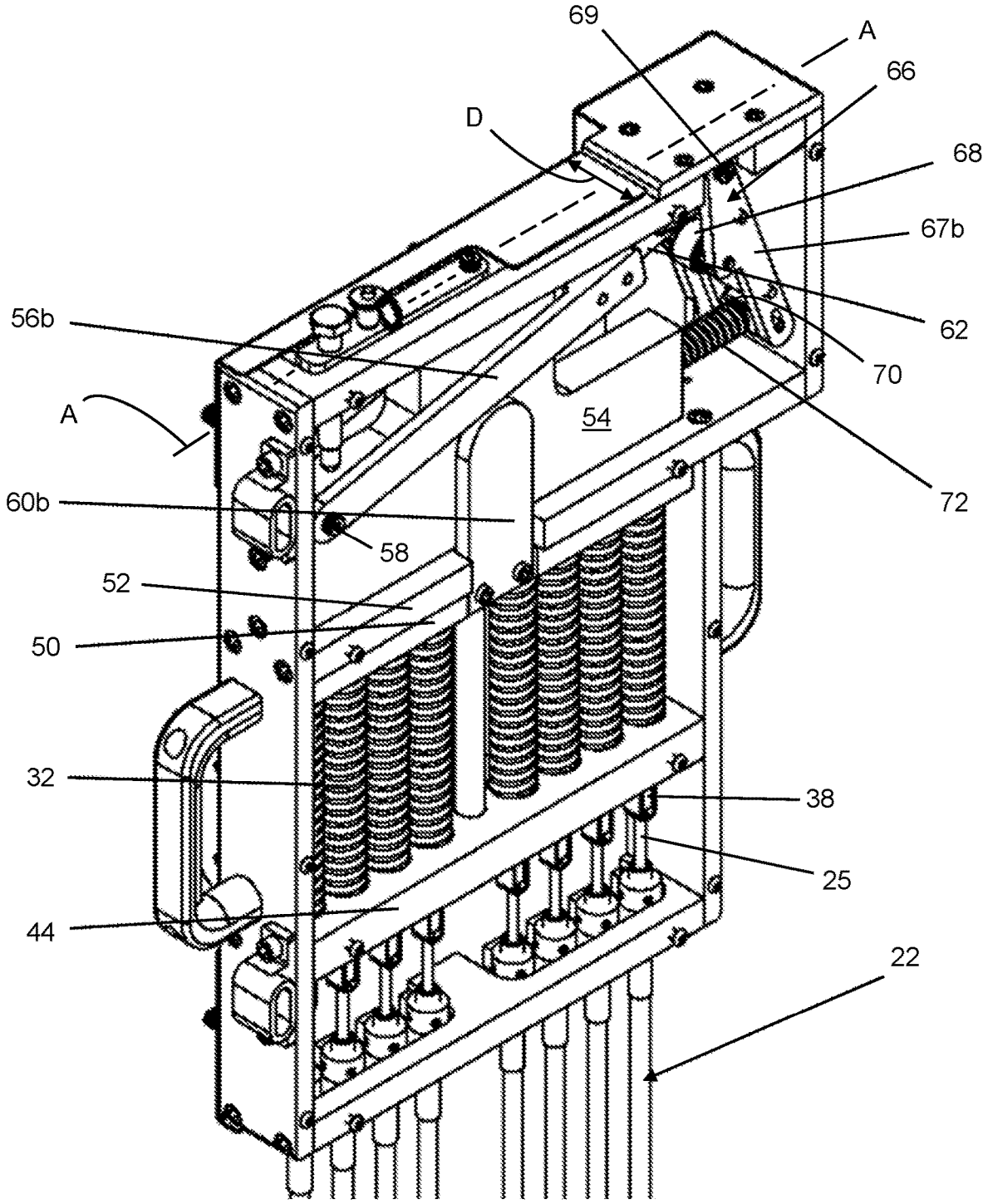
FIG. 7 is a rear perspective view of the release module assembly of FIG. 1 from above, with exterior panels removed to show internal components in a released configuration.

FIGS. 5-7 illustrate the disclosed release module assembly 10 in a released state. When the trigger device such as the dereefer 26 shown in FIG. 1 frees the release lever 24, the bias of the release lever spring 72 and the force generated by the tip 62 of the lock beam 56 on the roller 68 move the release lever 24 to a position that allows the lock beam 56 to move from the cocked position (shown in FIGS. 2-4) to the released position (shown in FIGS. 5-7). In the released position, the lock beam 56 is pivoted toward the second end 36 of the frame 28 and the ram 50 can move from the retracted position to the extended position. The actuation rods 38 move with the ram 50 toward the second end 36 of the frame 28 and apply a pulling actuation force to all of the cables 25 at the same time. The cables 25 transmit the actuation force to the releasable couplings 20 simultaneously, releasing the couplings 20 and freeing the cargo 14 from the platform 12. Movement of the ram 50 toward the second end 36 of the frame is limited by the stop 52, so the springs 32 are never fully extended and loose, but are retained between the ram 50 and the bar 44, surrounding the actuation rods 38. The bar 44 and ram 50 may define recesses or sockets to receive the longitudinal ends of the springs 32.

Figure 8:
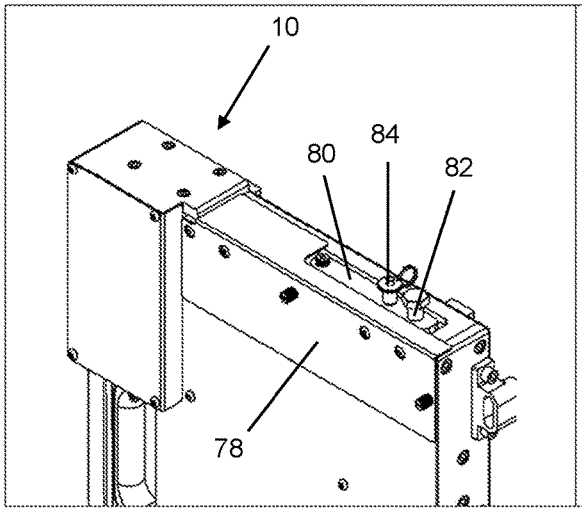
FIGS. 8-11 are front perspective views of the release module assembly of FIGS. 1-7 from above, with an end cover and external components hidden to show one disclosed method of placing the release module assembly in a locked configuration.
Figure 9:
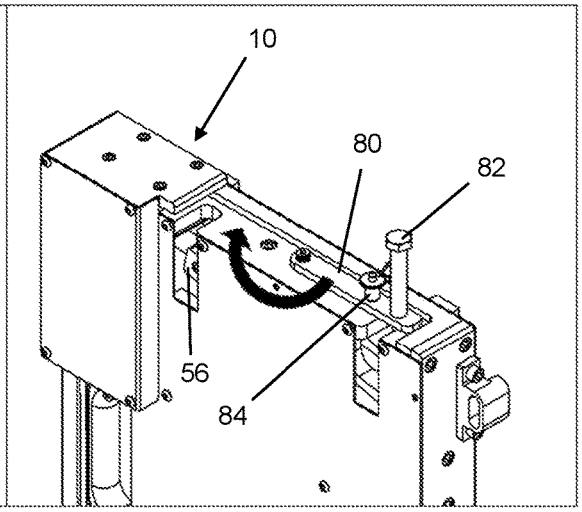
Figure 10:
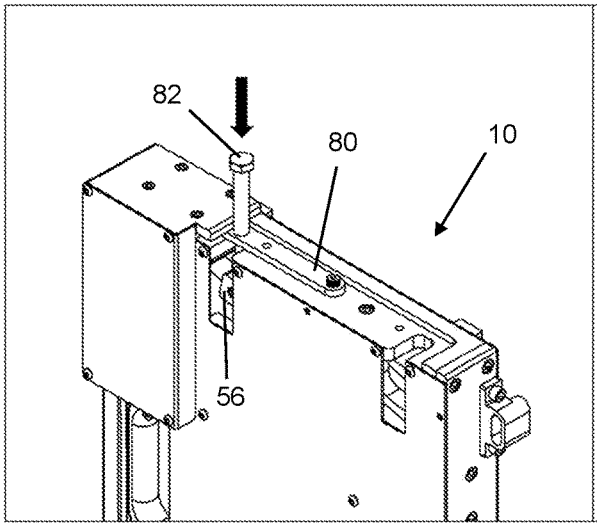
Figure 11:
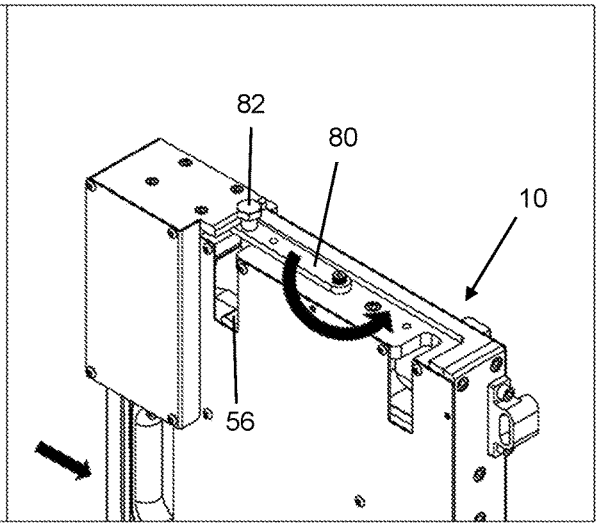

The combined spring force of the springs 32 is large, and the disclosed release module assembly 10 includes a mechanism for compressing the springs 32 to place the release module assembly in the cocked position. The second end 36 of the release module assembly 10 includes a cover 78 which, when removed as shown in FIG. 8, allows operation of a set plate 80 and jack screw 82. The jack screw 82 is backed out of its threaded opening in the set plate 80, a pin 84 is removed and the set plate 80 is rotated from a stowed position (shown in FIGS. 8 and 9) to a set position shown in FIG. 10. A free end of the set plate 80 is received beneath a cover to support the set plate 80 during cocking of the release module assembly 10. The jack screw 82 is tightened through the set plate 80 to drive the lock beam 56 to the cocked position. With the jack screw 82 holding the lock beam 56 in the set position, the release lever 24 is moved against the bias of the release lever spring 72 to the position where the roller 68 contacts the lock beam tip 62 and holds the lock beam 56 in the cocked position. The release lever 24 is then secured in this position using the safety pin 76. The jack screw 82 is then backed out of the set plate 80, the set plate 80 is returned to its stowed position, the pin 84 is reinserted to retain the set plate 80 in the stowed position and the cover plate 78 is replaced. The release module assembly 10 is now in the cocked state, with the springs 32 compressed and ready to be installed in an air cargo delivery system as shown in FIG. 12.

FIGS. 14 and 15 illustrate a representative releasable coupling 20 as disclosed in US2022/0324368, commonly assigned to the applicant and owner of the present application. Each releasable coupling 20 includes a main body 92, a latch arm 94, a lever arm 86, a rocker arm 88 and tie down attachment points 90. The latch arm 94, the lever arm 86, and the rocker arm 88 are all pivotably attached to the main body portion 92 of the releasable coupling 20. The latch arm 94 is configured to fit around a portion of an attachment point 18 on the cargo 14 in the closed position shown in FIG. 14. The lever arm 86 secures the latch arm 94 in the closed position and is additionally locked in position by the rocker arm 88, which prevents the lever arm 86 from rotating and keeps the latch arm 94 secured around the attachment point 18 as shown in FIG. 14. The cable 25 of the cable assembly 22 is connected to the rocker arm 88 and when retracted, moves the rocker arm 88 to the released position shown in FIG. 15. The latch arm 94 and lever arm 86 are spring biased toward the released position of FIG. 15 and when the rocker arm 88 is moved by retraction of the cable 25, the coupling springs open as shown in FIG. 15. Further, the tie down straps 16 attached to the tie down attachment points 90 are under tension and release of the rocker arm 88 allows the tension on the tie down straps 16 to open the coupling 20 and release the cargo 14 from the platform 12. In the cargo assembly shown in FIG. 12, four attachment points 18 on each side of the marine craft (cargo) 14 are secured to the platform 12 by tie down straps extending from the tie down attachment points 90 of the releasable coupling 20 to the platform 12. There are a total of eight releasable couplings 20 in this cargo assembly, each of which is connected to the release module assembly by a cable assembly 22. The disclosed release module assembly 10 retracts all eight cables 25 simultaneously to release all eight couplings 20 at the same time, the straps 16 fall away and the cargo 14 is released from the platform 12.

What is claimed:

1. A release module assembly comprising:

a frame having a first end, a second end and first and second sides extending between the first and second ends;

a bar extending between the first and second sides and mounted in a fixed position spaced apart from the first and second ends, said bar defining a plurality of openings extending in a longitudinal direction;

a ram extending between the first and second sides and movable in a longitudinal direction between a retracted first position and an extended second position relative to said bar;

a plurality of rods extending in a longitudinal direction through the plurality of openings in the bar, a first end of each of said plurality of rods connected to the ram for movement with the ram between the first and second positions, a second end of each rod extending from said bar in a longitudinal direction toward the first end of the frame;

at least one bias member compressed between the bar and the ram to bias the ram toward the second position;

a lock beam moveable between a cocked position holding the ram in the first position and a released position allowing the ram to move to the second position;

a release lever moveable between a first position holding the lock beam in the cocked position and a second position allowing the lock beam to move to the released position, wherein movement of the release lever from the first position to the second position allows the lock beam to move to the released position, the at least one bias member extends to move the ram to the second position, pulling the plurality of rods away from the first end of the frame.

2. The release module assembly of claim 1, wherein the lock beam is biased toward the released position by the ram and the lock beam has a tip engaged by the release lever, said tip having a profile configured to translate bias on the lock beam into force on the release lever, said force moving the release lever away from the lock beam.

3. The release module assembly of claim 1, wherein said release lever includes a roller that contacts the lock beam when the lock beam is in the cocked position.

4. The release module assembly of claim 1, wherein the lock beam extends from a pivot end pivotably mounted relative to said frame and a tip engaged by the latch, said lock beam pivoting about said pivot end to move from the cocked position to the released position.

5. The release module assembly of claim 4, wherein the ram includes a projection extending toward the frame second end, said projection contacting the lock beam between the lock beam pivot end and the tip of the lock beam.

6. The release module assembly of claim 4, wherein the lock beam tip moves toward the second end of the frame when the lock beam moves from the cocked position to the second position.

7. The release module assembly of claim 1, wherein the bar defines a guide opening at a midpoint of the bar, a guide rod extends from the ram through the guide opening to guide movement of the ram as it moves between the retracted first position and the extended second position.

8. The release module assembly of claim 1, comprising a center wall extending from the first side of the frame toward the second side of the frame, wherein the lock beam comprises front and rear arms on opposite sides of the center wall, said front and rear arms pivotably mounted at a lock beam pivot end adjacent the first side of the frame, the lock beam having a tip opposite said pivot end, said tip arranged between said front and rear arms and aligned with the center wall.

9. The release module assembly of claim 1, comprising a center wall extending from the first side of the frame toward the second side of the frame, said ram includes projections extending toward the frame second end on opposite sides of the center wall, said projections contacting the lock beam on opposite sides of the center wall between a pivot end of the lock beam and a tip of the lock beam where the lock beam engages the release lever.

10. The release module assembly of claim 1, comprising:

a plurality of cable assemblies secured at the first end of the frame, each of said plurality of cable assemblies comprising a sheath fixed to the first end of the frame and a cable extending within and moveable relative to the sheath, each of the plurality of cables connected to the second end of each of the plurality of rods so movement of the plurality of rods away from the first end of the frame exerts a pulling force on the plurality of cables at the same time.

11. The release module assembly of claim 1, wherein the release lever is pivotably mounted at the frame second end and extends to a free end, said release module assembly comprising a safety pin arranged to hold the release lever in the first position by contacting the release lever between the frame second end and the free end of the release lever.

12. The release module assembly of claim 1, wherein said release lever is biased toward the second position.

13. The release module assembly of claim 1, comprising a trigger mechanism coupled to the release lever, wherein the trigger mechanism holds the release lever in the first position until the occurrence of a triggering event and upon occurrence of the triggering event, allows the release lever to move to the second position.

14. The release module assembly of claim 13, wherein the trigger mechanism is a timer, a pressure altimeter, or a sensor.

15. A single point release system comprising:

a platform;

a plurality of latches connecting at least one strap to the platform, each said latch comprising a releasable latch arm, a rocker arm, and a control cable, wherein the control cable is connected to control the position of the rocker arm and wherein each latch is releasable from a payload on the platform in response to a position of the rocker arm; and a release module assembly of claim 1, wherein the control cable of each said latch is connected to one of the plurality of rods and movement of the release lever to the second position in response to a predetermined condition simultaneously releases each of the plurality of latches.

* * * * *